US005174042A

United States Patent [19]

Tomizawa et al.

[11] Patent Number: 5,174,042

[45] Date of Patent: Dec. 29, 1992

[54] GARBAGE DISPOSER UTILIZING MICROWAVE HEATING

[75] Inventors: Takeshi Tomizawa, Ikoma; Tatuo Fujita, Osaka; Jiro Suzuki, Nara, all of Japan

[73] Assignee: Matsushita Electric Industrial Co., Ltd., Osaka, Japan

[21] Appl. No.: 748,186

[22] Filed: Aug. 20, 1991

[30] Foreign Application Priority Data

| | | | |
|---|---|---|---|
| Aug. 20, 1990 | [JP] | Japan | 2-219259 |
| Aug. 20, 1990 | [JP] | Japan | 2-219261 |
| Aug. 20, 1990 | [JP] | Japan | 2-219293 |
| Nov. 27, 1990 | [JP] | Japan | 2-328535 |
| Nov. 27, 1990 | [JP] | Japan | 2-328538 |
| Dec. 19, 1990 | [JP] | Japan | 2-403842 |

[51] Int. Cl.[5] ..... B01K 5/00

[52] U.S. Cl. ..... 34/1 V; 219/10.55 R

[58] Field of Search ..... 34/1 P, 1 Q, 1 S, 1 U, 34/1 V, 17, 18, 68, 72, 73; 219/10.55 R, 10.55 B, 10.55 D, 10.55 F, 10.55 E

[56] References Cited

U.S. PATENT DOCUMENTS 4,937,411 6/1990 Suzuki et al. ..... 110/250 X

*Primary Examiner*—Herny A. Bennet

*Attorney, Agent, or Firm*—Wenderoth, Lind & Ponack

[57] ABSTRACT

An electric garbage disposer of a construction comprising a container means having an opening defined therein and made of microwave shielding material; and a garbage receptacle having a receiving mouth defined therein and made of material having both of a microwave permeable property and a gas permeable property. The garbage receptacle is adapted to be removably accommodated within the container means with the mouth substantially aligned with the opening of the container means. A microwave generating means is used for radiating microwaves into the container means to heat garbage contained in the garbage receptacle within the container means. A water component produced by the garbage as a result of microwave heating is drained to an outside of the garbage disposer.

32 Claims, 4 Drawing Sheets

GARBAGE DISPOSER UTILIZING MICROWAVE HEATING

BACKGROUND OF THE INVENTION

1. Field of the Invention

The present invention generally relates to a garbage disposer and, more particularly, to the garbage disposer designed to minimize the weight and the volume of garbage such as refuse from a home kitchen thereby to render it to be a sanitary disposable refuse.

2. Description of the Prior Art

The garbage from a home kitchen generally consists of unusable or unwanted pieces of animal and/or vegetable matter, eggshells, etc., and contains a relatively high percentage of water component. The garbage is a major component of the waste produced each day from a home. When it comes to garbage disposal, a garbage gathering system is generally employed in which the garbage is gathered at a prescribed place and at a prescribed time and is then transported to an incinerating facility by means of a garbage truck for an intensive incineration thereof.

So long as the garbage gathering system is employed, the garbage is to be kept somewhere in a house up until the prescribed time comes for the garbage gathering and, yet, one is required to carry the garbage to the prescribed place where the garbage truck comes for collecting the garbage gathered there.

In order to minimize or substantially eliminate those inconveniences inherent in the garbage gathering system, suggestions have been rendered to dispose the garbage at a place of origin of the garbage. One of those suggestions includes the use of a garbage disposal, an electric device installed in the drain of a kitchen sink for grinding up garbage into pieces ready to be washed down the drain. However, in some countries including Japan, because of an insufficient handling capacity of the sewage disposal plant and/or because of an effort to minimize a contamination of river systems with organic matter, the use of the home garbage disposal is prohibited or regulated by local governments or administrative offices.

The other suggestions include a heating system using a heater and a freezing system effective to minimize the emission of an obnoxious smell, however, they have not yet been put into widespread use.

As hereinbefore described, the garbage from a home kitchen contains a relatively high percentage of water component and is susceptible to decay. Where the decay of the garbage is desired to be minimized or substantially eliminated, this can be accomplished by using one or a combination of two methods in which the garbage is dehydrated to prevent it from being putrefied and in which, if the garbage is putrefied to a certain extent, the garbage is heated to prevent it from being further putrefied.

Considering that the garbage from a home kitchen is required to be kept somewhere in a house for a few days up until the prescribed time comes for the garbage gathering, the emission of an obnoxious smell as a result of the progress of putrefaction is one of serious problems. Another one of the serious problems is that, since the presence of the water component makes the garbage as a whole to be heavy, it may be a substantial labor for one to carry a bag of garbage from the home to the prescribed place of garbage gathering. Also, it may often occur that a spilling of the water component of the garbage from the bag during a transportation from the home to the prescribed place of garbage gathering may constitute a secondary cause of emission of an obnoxious smell. Those problems are especially desired to be eliminated in a housing area or an apartment-house.

SUMMARY OF THE INVENTION

The present invention has therefore been devised with a view to substantially eliminating the above discussed problems and inconveniences and is intended to provide an improved electric garbage disposer of a type utilizing a microwave oscillator for drying the garbage to reduce the weight and the volume of garbage such as refuse from a home kitchen thereby to render it to be a sanitary disposable refuse.

Another important object of the present invention is to provide an improved electric garbage disposer of the type referred to above which can be operated with a minimized consumption of electric power and wherein means is provided for maximizing the utilization of heat produced as a result of the drying of the garbage.

The above described objects of the present invention can be accomplished by providing an electric garbage disposer of a construction comprising a container means having an opening defined therein and made of microwave shielding material; and a garbage receptacle having a receiving mouth defined therein and made of material having both of a microwave permeable property and a gas permeable property. The garbage receptacle is adapted to be removably accommodated within the container means with the mouth substantially aligned with the opening of the container means. A microwave generating means is used for radiating microwaves into the container means to heat garbage contained in the garbage receptacle within the container means. A water component produced by the garbage as a result of microwave heating is drained to an outside of the garbage disposer.

Preferably, the container means has an inner surface coated with a material selected from the group consisting of ceramics and fluorinated resin. Also preferably, the garbage receptacle is a paper bag made of pulp compounded with synthetic resin.

The electric garbage disposer according to the present invention may also comprise a forced cooling means for condensing exhaust vapor, produced inside the container means when the garbage is heated by the microwave heating device, into water component.

In accordance with the present invention, the container means may comprise a container of a generally cylindrical configuration open at one end in communication with the mouth. The garbage retainer may be retained in position with its mouth-defining lip regions clamped between a generally ring-shaped retainer frame and a complementally shaped seat frame for receiving the retainer frame. Preferably, the seat frame has an inner diameter which is smaller than the inner diameter of the container, thereby to provide an annular space between the garbage receptacle and the wall of the container when the garbage receptacle is placed inside the container.

The container means may include an outer casing surrounding the container while defining an air chamber between the casing and the container. The air chamber has inflow and outflow ports and may be fluid-coupled with an air supply means for supplying air into the air chamber.

The condensed water component or the exhaust air, which has been forcibly cooled and discharged from the electric garbage disposer may be utilized in an externally coupled, automatic dishwasher for washing and drying dishes and other tableware.

BRIEF DESCRIPTION OF THE DRAWINGS

These and other objects and features of the present invention will become clear from the following description taken in conjunction with preferred embodiments thereof with reference to the accompanying drawings in which like parts are designated by like reference numerals and in which.

DETAILED DESCRIPTION OF THE EMBODIMENT

Figure 1:
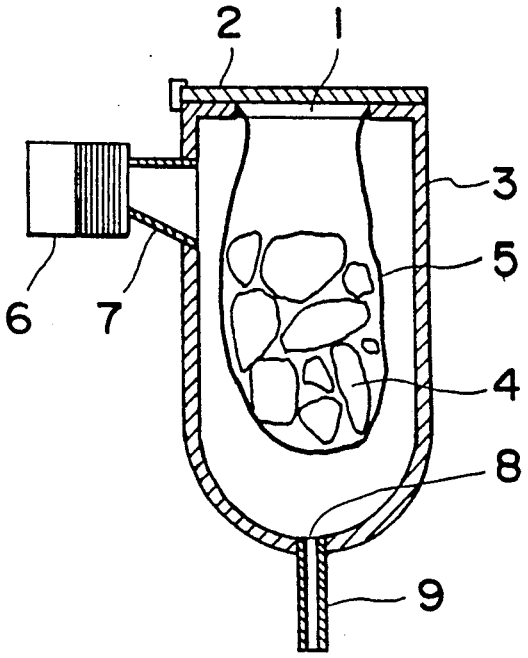
FIG. 1 is a schematic side sectional view of an electric garbage disposer according to a first preferred embodiment of the present invention.

Referring to FIG. 1, an electric garbage disposer according to a first preferred embodiment of the present invention comprises a generally cylindrical container 3 opening upwardly and having a downwardly convexed bottom and an annular top wall having a garbage receiving mouth 1 defined therein. The downwardly convexed bottom has a drain port 8 defined therein which is fluid-connected with a drain tube 9 extends downwardly from the bottom of the container 3 for a drainage of water component from the container 3 to the outside.

The garbage receiving mouth 1 is adapted to be selectively sealed and opened by a lid 2 which is hingedly secured to the container 3 adjacent the annular top wall. The lid 2 is made of a material having a high temperature resistance and also having a microwave impermeable property and is capable of gas-tightly sealing the garbage receiving mouth 1 enough to avoid any possible leakage of obnoxious smell from the inside to the outside of the container 3.

The container 3 is adapted to accommodate therein a disposable bag 5 containing garbage 4 from a home kitchen, said bag 5 being made of microwave permeable material.

The illustrated garbage disposer also comprises a microwave heating device 6 in the form of an microwave oscillator (or magnetron) coupled with the container 3 by means of a waveguide 7.

The garbage disposer of the construction shown in and described with reference to FIG. 1 is operated in the following manner. Assuming that an empty garbage bag 5 is placed inside the container 3 with its opening aligned with the garbage receiving mouth 1, garbage 4 from a kitchen is thrown into the garbage bag 5 through the garbage receiving mouth 1. After the garbage 4 has been thrown into the bag 5, the lid 2 has to be pivoted from an open position towards a closed position, as shown, to seal the garbage receiving mouth 1. Thereafter, the microwave heating device 6 is activated in any known manner to accomplish a microwave heating. During this microwave heating process, the microwave penetrate into the garbage bag 5 and is selectively absorbed by water components present in the garbage 4 within the bag 5.

As the microwave heating process progresses, the garbage 4 is dried while emitting vapor which is subsequently cooled in contact with the wall of the container 3 to condense into water droplets, said water droplets being drained into the drain tube 9 through the drain port 8.

According to the foregoing embodiment, since the microwave heating can be accomplished without allowing the vapor and the condensed water droplets to stay within the container 3, the garbage 4 can be readily dried. After the microwave heating process has been terminated, the dried garbage 4 can be removed out from the container 3 in the form as accommodated within the bag 5 and, therefore, no one need to touch the garbage 4.

Also, since the microwave heating is carried out while the garbage 4 is accommodated within the bag 5, an inner surface of the container 3 will not be substantially contaminated with tar or like viscid matter. The contamination of the inner surface of the container 3 can be more effectively eliminated if the inner surface of the container 3 is coated with ceramics or fluorine resin.

Where the garbage bag 5 is in the form of a paper bag made of a mixture of wood pulp and synthetic resin, the garbage bag 5 can have a favorable gas permeability and a favorable moisture permeability. Hence, the garbage bag 5 can serve as a filter during the microwave heating process, and therefore, the vapor originating from the garbage 4 can be filtered to leave inside the garbage bag 5 solid particles and viscid matter contained in the vapor. Alternatively, the garbage bag 5 may be in the form of either a solid bag, made of high-temperature resistant film of plastics, or a finely perforated bag or net bag made of high-temperature resistant plastics.

Figure 2:
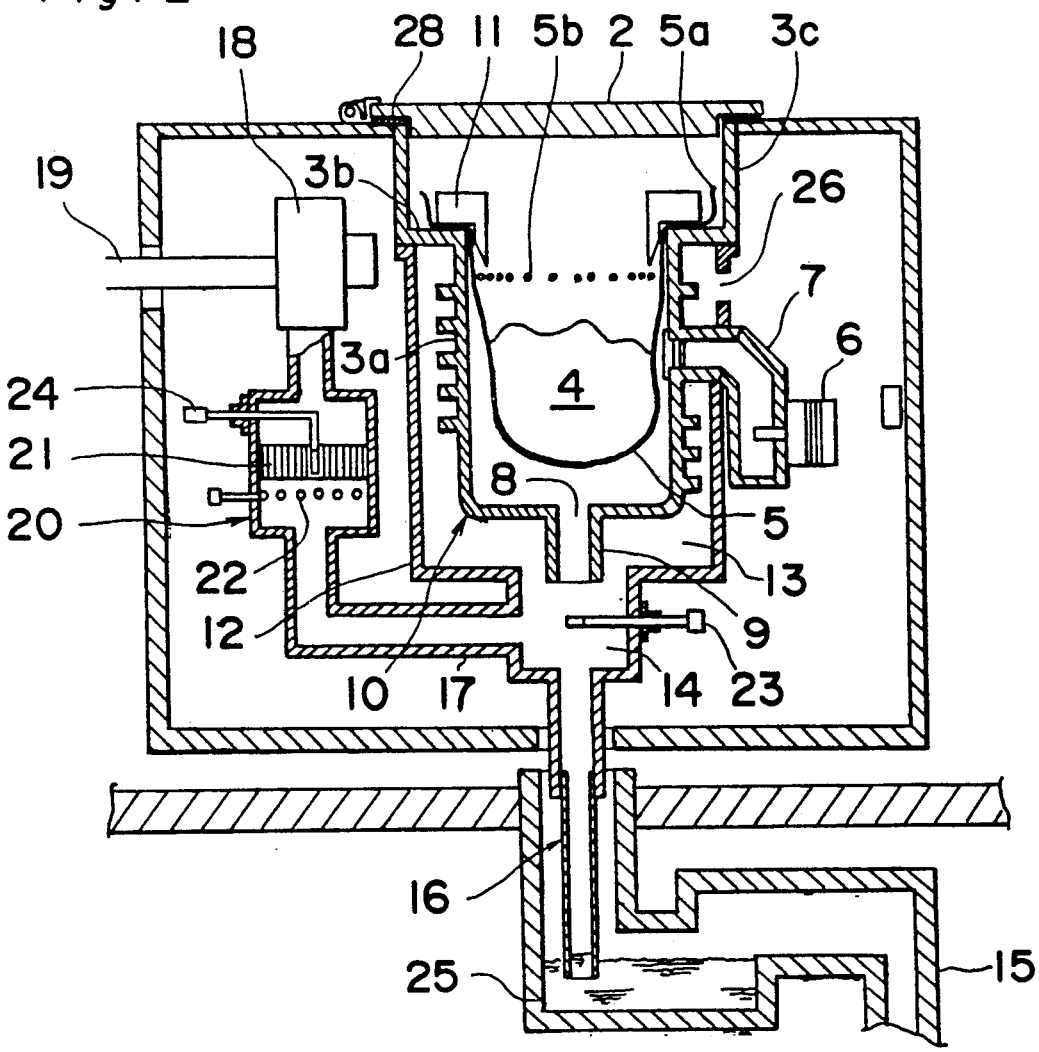
FIG. 2 is a schematic side sectional view of the electric garbage disposer according to a second preferred embodiment of the present invention.
Figure 3:
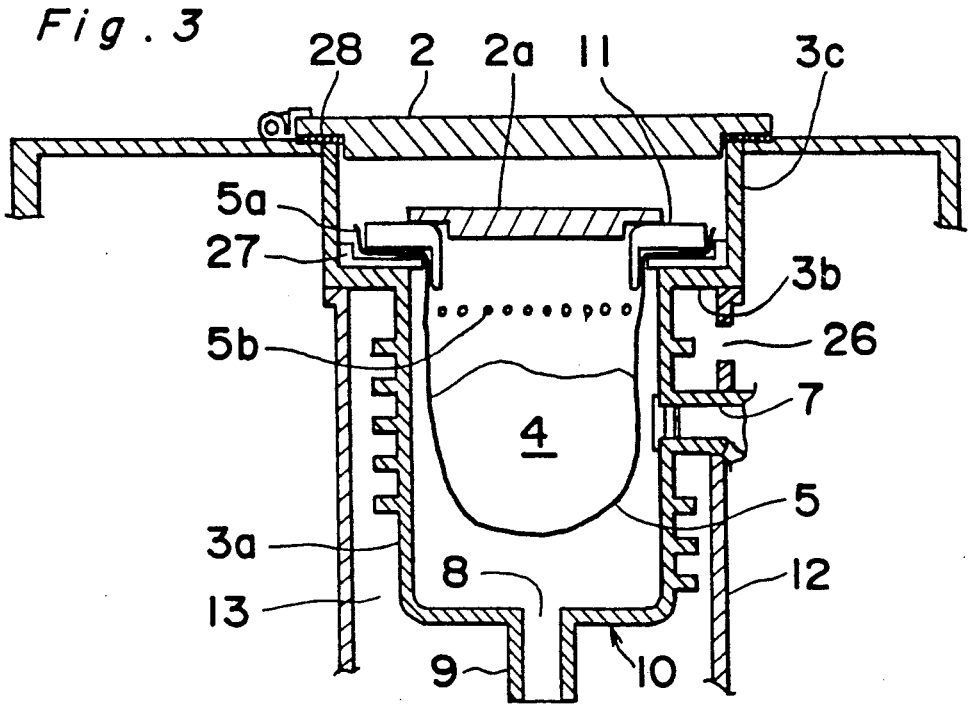
FIG. 3 is a schematic side sectional view, on a somewhat enlarged scale, of a portion of the electric garbage disposer of FIG. 2, showing a modification thereof.

The garbage disposer according to a second preferred embodiment of the present invention is shown in FIGS. 2 and 3. Referring first to FIG. 2, the garbage disposer shown therein comprises a garbage container 10 which may be of one-piece construction including a generally cylindrical body **3*a* closed at a bottom end thereof and open at a top end thereof, a annular flange 3*b* protruding radially outwardly from the open top end thereof, and a cylindrical upright wall 3*c* protruding upwardly from an outer peripheral portion of the annular flange 3*b* in alignment with the longitudinal axis of the container body 3*a*. As will be described later, the annular flange 3*b* protruding radially outwardly from the open top end of the container body 3*a* serves as a seat cooperable with a generally ring-shaped retainer frame 11 which is used to clamp a mouth-defining lip region 5*a* of the garbage bag 5 between it and the annular flange or seat 3*b***.

The opening of the cylindrical upright wall **3*c* remote from the container body 3*a* is adapted to be selectively closed and opened by the hingedly supported lid 2**.

The container body **3*a* of the garbage container 10 is substantially enclosed by a correspondingly cylindrical casing 12 having an air chamber 13, defined between it and the container body 3*a*, and a gas-liquid separating chamber 14 defined immediately below the drain tube 9. The gas-liquid separating chamber 14 is communicated with a drain duct 15 through a drain piping system 16 and also with a vapor exhaust tube 17 which leads to a ventilating fan assembly 18 through a deodorizing unit 20. The ventilating fan assembly 18 has a discharge port to which an exhaust duct 19** is connected.

The deodorizing unit 20 disposed between the vapor exhaust tube 17 and the ventilating fan assembly 18 is of a type comprising a generally tubular casing including a deodorizing catalyst 21 and a heater 22 for heating the catalyst 21 for the purpose which will become clear from the subsequent description.

Reference numerals 23 and 24 represents temperature sensors for detecting a temperature inside the gas-liquid separating chamber 14 and that of the catalyst 21, respectively. Reference numeral 25 represents a trap defined in the drain duct 15. Reference numeral **5*b* represents perforations in the garbage bag 5 where the latter is employed in the form of the finely perforated bag. Reference numeral 28** represents an annular elastic gasket made of, for example, electroconductive rubber material, and effective to seal both the microwave and the air.

The garbage disposer according to the second embodiment of the present invention operates in the following manner.

Assuming that the finely perforated bag 5 is removably placed inside the container 10 with the mouth-defining lip region **5*a* of the garbage bag 5 clamped between the retainer frame 11 and the annular seat 3*b*, the lid 2 is opened and garbage 4 from a kitchen is then thrown into the garbage bag 5. After the garbage 4 has been thrown into the bag 5, the lid 2 has to be pivoted from an open position towards a closed position as shown. Thereafter, the microwave heating device 6 is activated in any known manner to oscillate microwaves which are introduced into the container 10 through the waveguide 7 to accomplish a microwave heating. As the microwave heating proceeds, the garbage 4 is dried while emitting vapor. The garbage bag 5 made of microwave permeable material such as polyethylene does not absorb the microwaves and is not substantially heated. The vapor so produced escapes from the garbage bag 5 into the interior of the container 10 through the perforations 5*b* (or interstices of the bag 5 if the latter is made of paper material) to fill up the container 10**.

However, since a forced draft of air produced by the ventilating fan assembly 18 is introduced into the air chamber 13 through an inlet opening 26 so as to circulate within the air chamber 13 exteriorly around the garbage container 10 thereby to cool the wall of the container 10, the vapor within the container 10 is cooled in contact with the wall of the container 10 to condense into water droplets which are subsequently drained into the drain tube 9 through the drain port 8. It is to be noted that the drain tube 9 has an inner diameter smaller than one fourths of the wavelength of the microwave used and, therefore, no microwave will penetrate therethrough to the outside of the container 10.

The condensed water droplets and a remaining portion of the vapor within the container 10 are discharged downwardly through the drain tube 9 into the gas-liquid separating chamber 14. The water droplets flowing into the gas-liquid separating chamber 14 fall into the drain piping system 16 and then into the drain duct 15 or, alternatively, a water tank (not shown), while the vapor flowing into the gas-liquid separating chamber 14 is discharged to the outside through the vapor exhaust tube 17 together with the forced draft of air which has been used to cool the wall of the garbage container 10 as hereinbefore described and is, therefore, heated as a result of heat exchange.

The mixed vapor and air flowing through the exhaust tube 17 is of a high temperature and a low relative humidity and is not therefore condensed during the flow therethrough. It is to be noted that, since the polyethylene resin used to form the garbage bag 5 of a type resistant to the elevated temperature comparable to the temperature of a water vapor, the garbage bag 5 will not melt even though it may be heated to a temperature comparable to that temperature, while allowing only the garbage 4 to be dried.

It is also to be noted that, if an electric drive circuit (not shown) is so designed as to permit the microwave heating device 6 to be driven intermittently or as to permit the microwave heating device 6 to generate the microwave of an intensity progressively lowering with passage of time representative of a drying time, any possible damage to the garbage bag 5 can be advantageously minimized. The progress of drying of the garbage 4 within the bag 5 can be indicated by a reduction in temperature inside the gas-liquid separating chamber 14 sensed by the temperature sensor 13. Alternatively, it may be indicated by an increase of the temperature of the microwave heating device (magnetron) 6, reduction in weight of the garbage 4 in the bag 5 or any other parameter which may increase or decrease with passage of time during which the microwave heating device 6 is operated.

After the microwave heating has been completed, the garbage 4 is substantially completely dried up and will not therefore be putrefied even though the dried garbage 4 is left remaining within the garbage bag 5 for a substantial period of time. Therefore, if desired or recommended, a single garbage bag 5 may be used repeatedly for a number of cycles of microwave heating until it become full of the dried garbage 4.

It is again to be noted that, with the progress of the drying time during which the microwaves are radiated to the garbage 4 within the bag 5, the garbage 4 emits a certain amount of cracked gases which may be a source of obnoxious smell. However, the employment of the deodorizing unit 20 between the vapor exhaust tube 17 and the ventilating fan assembly 18 and comprising the deodorizing catalyst 21 and the heater 22 is effective to oxidize the cracked gases thereby to deodorize them before they are emitted to the outside of the garbage disposer through the exhaust duct 19 by way of the ventilating fan assembly 18.

To place the empty garbage bag 5 inside the container 10, the ventilating fan assembly 18 may be utilized and operated to draw air inside the container 10 outwardly therefrom so that the empty garbage bag 5 can be drawn substantially deep into the container body **3*b* while being substantially radially outwardly expanded to assume a substantially bulged shape. Thereafter, or shortly before the bag 5 being bulged under the influence of the suction force, the user should set the annular retainer frame 11 in position to clamp the mouth-defining lip region 5*a* of the bag 5 between it and the annular seat 3*b***.

The garbage bag 5 has been described as accommodated within the container 10 with its mouth-defining lip region **5*a* clamped between the retainer frame 11** and the annular seat 3*b*. The garbage bag 5 is so shaped and so sized that, when the garbage bag 5 is supported in the manner shown and described, the bag 5 which may be heated substantially to 100° C. at a last stage of the microwave heating cycle will not contact with the wall of the container body 3*b*, and therefore, any possible loss of heat due to a heat conduction can be minimized advantageously. As a matter of course, the garbage bag 5 after the heat treatment can readily be removed out of the container 10 subsequent to a removal of the retainer frame 11 with no need for an user of the garbage disposer to touch the dried garbage within the bag 5.

The modification shown in FIG. 3 illustrates the use of an annular seat member 27 having an inner diameter smaller than the inner diameter of the container body 3*a* and cooperable with the retainer frame 11 to clamp the mouth-defining lip region 5*a* of the garbage bag 5. In this modification, the annular flange 3*b* which, according to the embodiment shown in and described with reference to FIG. 2, has been described serving as the seat cooperable with the retainer frame 11 no longer serve as the seat. This annular seat member 27 may be either secured rigidly to the annular flange 3*b* or removable therefrom together with the retainer frame 11 and hence the garbage bag 5.

According to the modification shown in FIG. 3, since the inner diameter of the annular seat member 27 is chosen to be smaller than that of the container body 3*a* of the container 10, the garbage bag 5 with its mouth-defining lip region clamped by the retainer frame 11 and the annular seat member 27 can depend into the container body 3*a* while substantially spaced inwardly from the wall of the container body 3*a*. This is particularly true when the garbage 4 is thrown into the garbage bag 5. This system is effective to enhance the minimization of the loss of heat due to the heat conduction from the bag 5 to the wall of the container body 3*a*.

The modification of FIG. 3 also shows the use of an inner lid 2*a* used to close an opening defined by the annular retainer frame 11 to avoid an entry of the vapor into a space delimited above the opening of the garbage bag 5 and between the lid 2, the inner lid 2*a* and the cylindrical upright wall 3*c* of the container 10. This is particularly advantageous in that inner surfaces of the lid and the cylindrical upright wall 3*c* confronting such space can be kept clean with no tar substantially adhering thereto. The use of the inner lid 2*a* can bring about an additional advantage in that any possible build-up of carbonized particles in a gap around the lid 2 can be avoided, which would otherwise form passages for the leakage of microwaves to the outside or constitute a cause of spark discharge. Preferably, the inner lid 2*a* is made of microwave permeable material to further avoid a possible occurrence of spark discharge which would results from absorption of the microwaves by the carbonized particles.

In the foregoing and subsequently described embodiments of the present invention, at least the garbage container 3 or 10 and the lid 2 are made of microwave shielding material. More specifically, as a matter of practice, in designing the garbage disposer utilizing the microwave heating system according to the present invention, due consideration is to be paid to general rules and/or standards for the prevention of microwave hazards.

Figure 4:
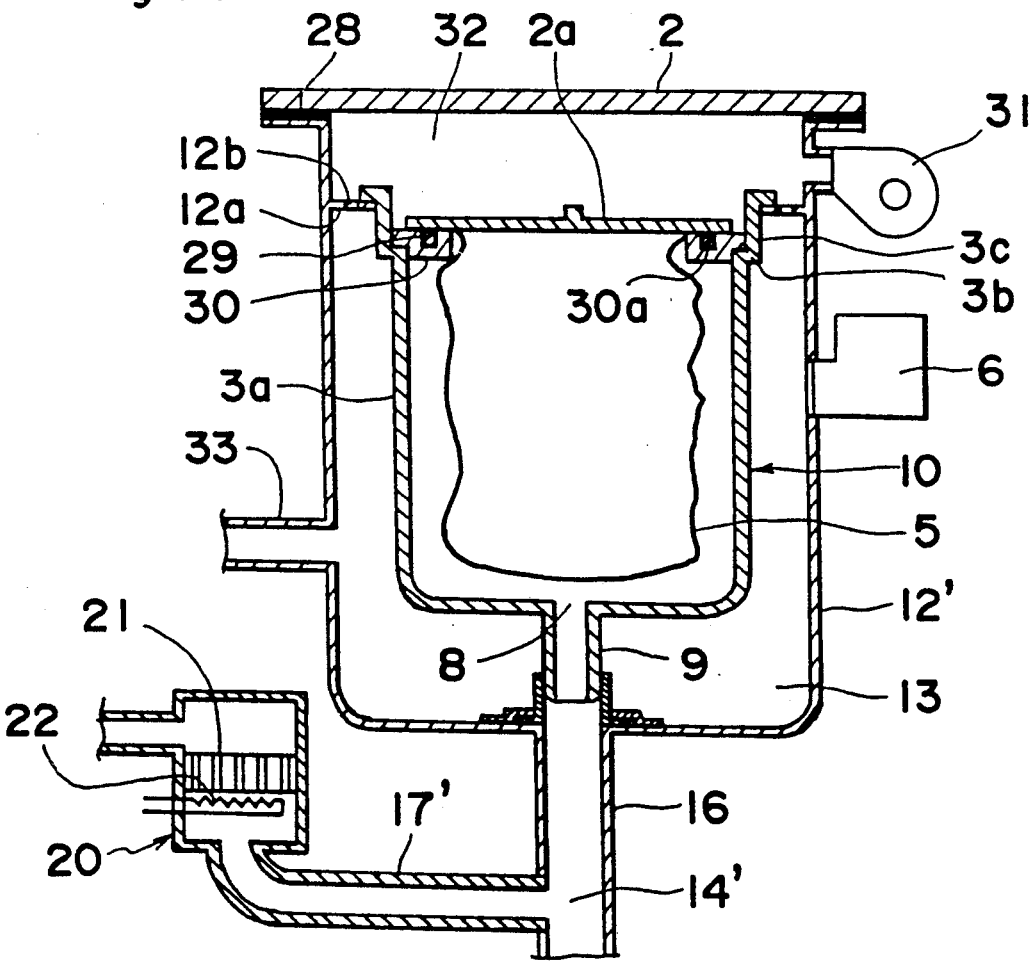
FIG. 4 is a schematic side sectional view of a portion of the electric garbage disposer according to a third preferred embodiment of the present invention.

Reference is now made to FIG. 4 showing the garbage disposer according to a second embodiment of the present invention. While in the embodiment shown in FIGS. 2 and 3, the cylindrical inner casing 12 has been shown to extend downwardly from an outer peripheral portion of the annular flange 3*b* of the container 10 while accommodating substantially only the container body 3*a*, the inner casing, now generally identified by 12', shown in FIG. 4 is of a size sufficient to completely accommodate the container 10 therein. The container 10 is supported in position within the inner casing 12' with an upper portion of the cylindrical upright wall 3*c* welded, or otherwise rigidly secured, to a radially inwardly extending flange 12*a* that is positioned a predetermined distance inwardly from the lid 2. The air chamber 13 is defined between the container 10 and the wall of the casing 12' and is communicated with the space between the outer and inner lids 2 and 2*a* through a plurality of perforations 12*b* defined in the radially inwardly extending flange 12*a* integral with the casing 12'.

In this embodiment of FIG. 4, instead of the combined use of the retainer frame 11 and the annular seat shown in and described with reference to FIGS. 2 and 3, a retainer ring 29, which is preferably flexible and/or elastic, is employed in cooperating relationship with a retainer groove 30*a* defined in an annular support 30 having an outer peripheral portion welded or secured rigidly to the annular flange 3*b* of the container 10 so as to extend radially inwardly therefrom. Thus, to place the garbage bag 5 inside the container 10, the mouth-defining lip region of the empty garbage bag 5 is spread over the annular support 30 so as to overlay the retainer groove 30*a* and the retainer ring 29 is then snapped into the retainer groove 30*a* to retain the mouth-defining lip region of the bag 5 in position as shown.

In the foregoing embodiment of FIGS. 2 and 3 the ventilating fan assembly has been shown and described as used for providing the forced draft of cooling air, which circulate through the air chamber 13, and also for exhausting the exhaust gases to the outside through the exhaust duct. In the embodiment of FIG. 4, however, separate ventilating fan assemblies may be employed if desired. Specifically, for supplying the forced draft of cooling air into the air chamber 13, a ventilating fan assembly 31 is employed for introducing it into the air chamber 13 through the space 32 between the lids 2 and 2*a* by way of the perforations 12*b* in the radially inwardly extending flange 12*a* of the casing 12'.

The forced draft of cooling air introduced into the air chamber 13 in the manner described above is, after having been used for the heat exchange with the heated wall of the container 10, discharged to the atmosphere through an exhaust duct 33.

The drain tube 9 extending downwardly from the bottom of the container body 3*a* is fluid-connected direct with the drain piping system 16 having a branch exhaust tube 17' branched off from the drain piping system 16. The branch exhaust tube 17' is in turn fluid-connected with the deodorizing unit 20. A gas-liquid separating chamber 14' is defined in a region of the drain piping system 16 where the branch exhaust tube 17' is branched off. If desired, another ventilating fan assembly (not shown) may be employed to positively exhaust the deodorized gases from the deodorizing unit 20 to the atmosphere.

Thus, it will readily be seen that the garbage disposer according to the third embodiment of the present invention shown in and described with reference to FIG. 4 functions in a manner substantially similar to that according to the second embodiment of FIGS. 2 and 3.

However, the third embodiment shown in FIG. 3 is particularly advantageous in that, since the ventilating fan assembly 31 is used to introduce the forced draft of cooling air into the space 32 prior to being introduced into the air chamber 13 through the perforations 12*b*, an obnoxious smell of the garbage then being heat-treated within the bag 5 inside the container 10 will not substantially enter the space 32 and then the air chamber 13 because the space 32 and the air chamber 13 are substantially pressurized, thereby minimizing a unwanted diffusion of the obnoxious smell to the outside. In other words, the forced draft of cooling air may be said to create an air curtain flowing so as to substantially encompass the container 10 to minimize an emission of the obnoxious smell outwardly from the container 10.

Figure 5:
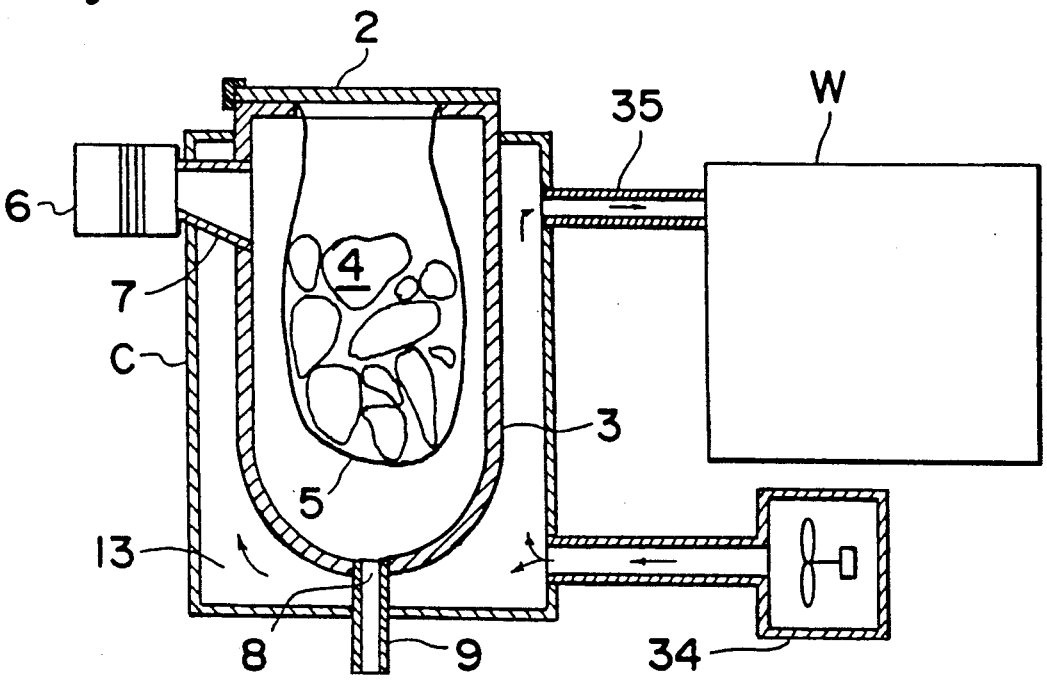
FIGS. 5 to 8 are schematic side sectional views showing fourth to seventh preferred embodiments of the present invention, respectively.
Figure 6:
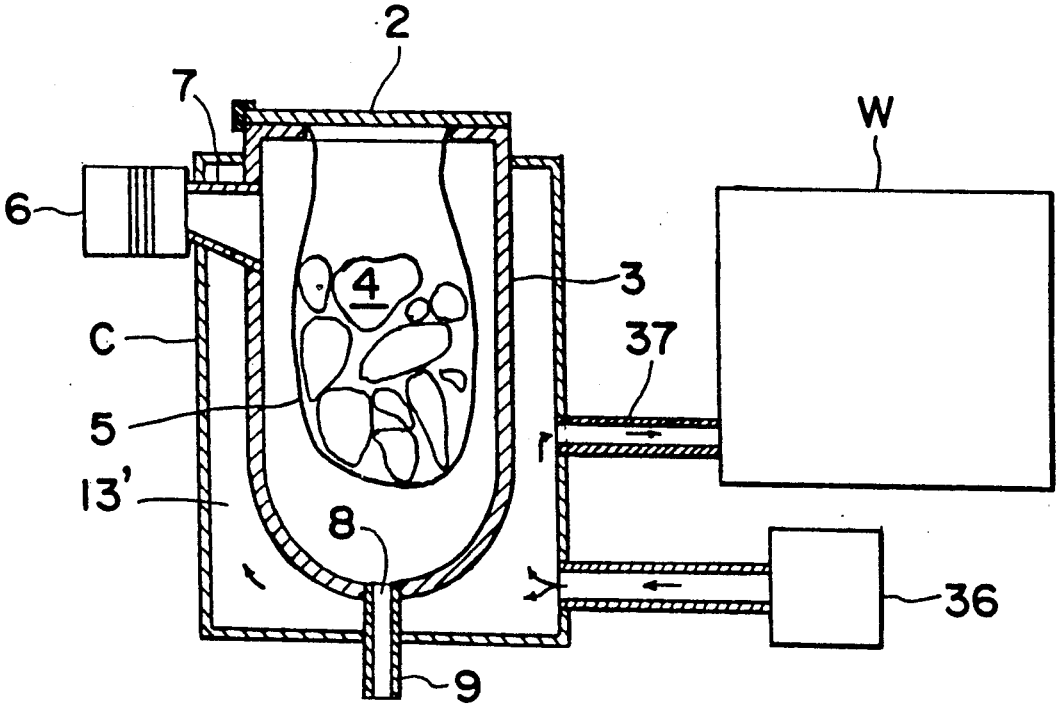

The garbage container 3 shown in and described with reference to FIG. 1 may be enclosed in a casing C, similar in construction to the casing 12′ shown in FIG. 4, to define the air chamber 13 between the container 3 and the casing C as shown in FIG. 5 or to define a water jacket 13′ between the container 3 and the casing C as shown in FIG. 6, respectively. In the fourth embodiment of the present invention shown in FIG. 5, a ventilating fan assembly 34 is used to supply the forced draft of cooling air into the air chamber 13 from a position adjacent the bottom of the casing C and to subsequently supply it into an automatic dishwasher W of any known structure through a connecting tube 35.

As hereinbefore discussed in connection with any one of the embodiments of FIGS. 2 to 4, the forced draft of cooling air introduced into the air chamber 13 is substantially heated as a result of the heat exchange with the container and evolve heat when discharged to the outside of the air chamber 13. Therefore, in the embodiment of FIG. 5, the heat evolved in the air discharged from the air chamber 13 is utilized to dry tableware which has been washed in the dishwasher W in any known manner.

On the other hand, in the fifth embodiment of the present invention shown in FIG. 6, instead of the use of the draft of cooling air, a cooling water is used and is supplied from a supply pump 36 into the water jacket 13′. The cooling water used to cool the container 3 is subsequently circulated through a connecting tube 37 into the automatic dishwasher W to wash the tableware during a washing cycle of operation of the dishwasher W.

In any one of the foregoing embodiments of the present invention, the garbage has been described as dried solely by the microwave radiation. However, the combined use of microwave radiation and a forced draft of hot air of elevated temperature is possible in the practice of the present invention. In any one of the sixth and seventh embodiments of the present invention shown respectively in FIGS. 7 and 8, a forced drying system is employed in combinatin with the microwave heating system for accelerating the drying of the garbage in the garbage bag 5.

Figure 7:
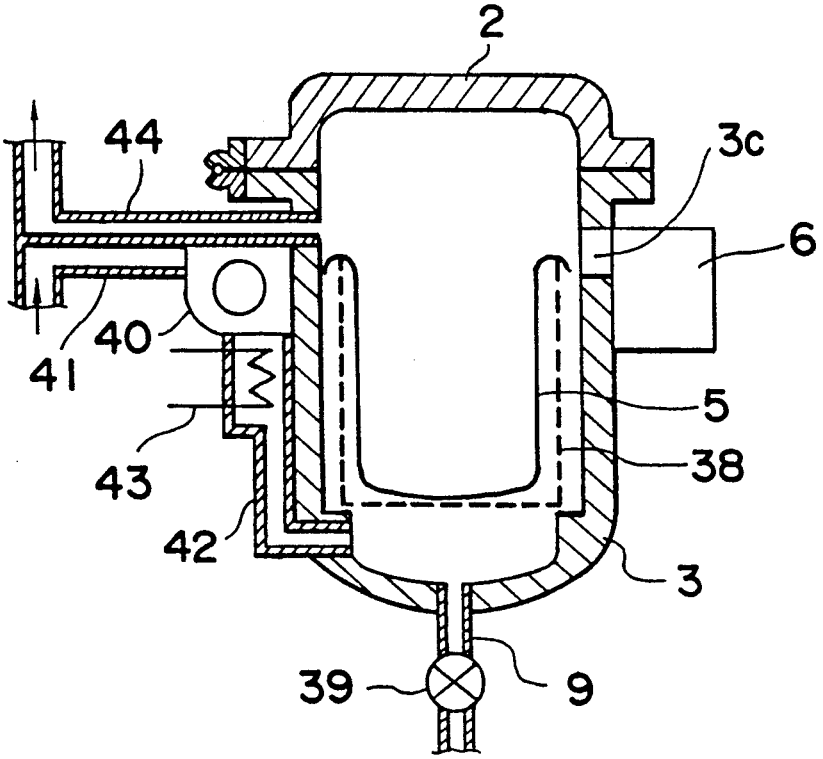

Referring now to FIG. 7, reference numeral 3*c* represents a microwave radiating window defined in the wall of the container 3, and reference numeral 38 represents a mesh basket for accommodating the garbage bag 5 therein. Reference numeral 39 represents a shut-off valve disposed on the drain tube 9 for selectively closing and opening the train tube 9.

In this embodiment of FIG. 7, the microwave heating device 6 is fitted exteriorly to the wall of the container 3 so that microwaves generated therefrom can penetrate into the container 3 through the radiating window 3*c*. The mesh basket 38 is preferably made of heat-resistant polyethylene and is removably placed inside the container 3.

A forced drying system comprises a blower 40 having an air intake port communicated with the atmosphere through an upstream duct 41 and an air outlet port communicated with the bottom of the container 3 through a downstream duct 42, and an electric heating element 43 disposed in the downstream duct 42 at a location adjacent the air outlet port of the blower 40. The heated or hot air introduced through the downstream duct 42 into the container 3 is used to dry the garbage in the garbage bag 5 and is subsequently discharged to the outside of the garbage disposer through an exhaust duct 44.

The upstream duct 41 and the exhaust duct 44 may be separate from each other. However, in the practice of the present invention, the upstream duct 41 and the exhaust duct 44 are substantially parallely joined together, or the both are defined in a single piping having a partition wall extending longitudinally thereof, to facilitate a heat exchange between the cool air flowing through the upstream duct 41 and the heated exhaust air flowing through the exhaust duct 44. In other word, the air sucked into the upstream duct 41 during the operation of the blower 40 can recover heat evolved by the exhaust air flowing through the exhaust duct 44 in a sense opposite to the air in the upstream duct 41.

In the embodiment of FIG. 7, the forced drying system may be operated in combination with the microwave heating device. Alternatively, the forced drying system may be operated only when the amount of garbage to be dried is substantial enough to require a relatively long time if the drying is relied only on the microwave heating device 6. In combination therewith or separate therefrom, the forced drying system may be operated for a predetermined time after the garbage in the bag 5 has been dried, thereby to ensure a substantially completely dried condition of the garbage.

It is to be noted that one or both of the upstream and exhaust ducts 41 and 44 may have a multiple of fins to facilitate the heat exchange.

It is also to be noted that the use may be made of a controller for controlling the heating element 43 and the power of the microwave heating device 6 so that, depending on the type of garbage to be heat-treated, one of the microwave radiation and the forced heating system can be selectively utilized. By way of example, where the garbage to be heat-treated contain a relatively large amount of water component, the microwave radiation would cause a boiling of the water component. Therefore, the controller may be so designed that, so long as the water content of the garbage is higher than a predetermined value, the electric power to be supplied to the microwave heating device 6 can be regulated to a value lower than a predetermined value and, on the other hand, the electric power to be supplied to the heating element 63 can be regulated to a predetermined power, but when the water content decreases to a value lower than the predetermined value, the proportion of distribution of the electric power supply to the microwave heating device 6 and the heating element 43 can be reversed.

Figure 8:
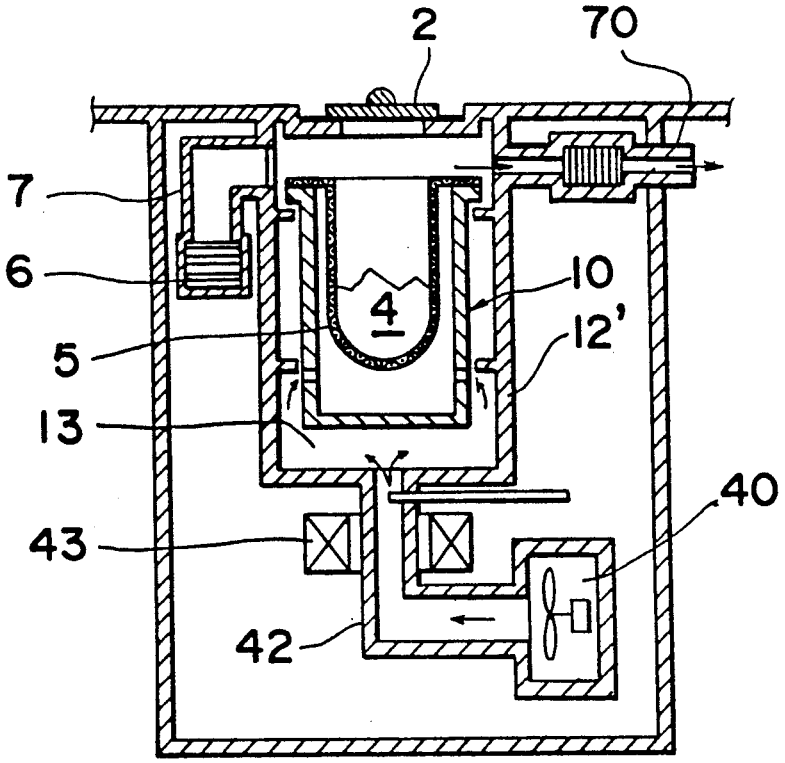

In the seventh embodiment of the present invention shown in FIG. 8, no forced cooling system is employed. While in any one of the foregoing embodiments the vapor produced as a result of the microwave heating of the garbage has been described as condensed into water droplets which are subsequently drained. However, in the embodiment shown in FIG. 8, no vapor is substantially condensed into the water droplets and, instead, the water content of the garbage is substantially completely evaporated. For this purpose, the container 10 has no drain port such as identified by 8 in any one of FIGS. 1 to 7 and gases resulting from the evaporation of the vapor are discharged to the atmosphere through the exhaust duct 70.

With the present invention having been described, it is to be noted that the garbage heat-treated in the garbage disposer of the present invention can be disposed to a weight which may be one fifth of the initial weight thereof, making it possible to lessen the labor one may suffer from when the garbage is to be thrown at the prescribed place of garbage gathering. In addition, the heat-treated garbage is substantially sterilized and is therefore sanitary to handle. Yet, even though the heat-treated garbage is left remaining within the garbage disposer, no emission of the obnoxious smell occur substantially.

Although the present invention has been described in connection with the preferred embodiments thereof with reference to the accompanying drawings, it is to be noted that various changes and modifications are apparent to those skilled in the art. By way of example, the container 3 or the container body 3*a* may have a plurality of fins welded to or intergrally formed with an outer surface thereof for facilitating the heat exchange.

Accordingly, such changes and modifications are to be understood as included within the scope of the present invention as defined by the appended claims, unless they depart therefrom.

What is claimed is:

1. A garbage disposer which comprises:

a container means having an opening defined therein and made of microwave shielding material;

a garbage receptable having a receiver mouth defined therein and made of material having both of a microwave permeable property and a gas permeable property, said garbage receptacle being adapted to be removably accommodated within the container means with the mouth substantially aligned with the opening of the container means;

a microwave generating means for radiating microwaves into the container means to heat garbage contained in the garbage receptacle within the container means; and a drain passage means for draining a water component produced by the garbage as a result of microwave heating, to an outside of the garbage disposer.

2. The garbage disposer as claimed in claim 1, wherein said container means has an inner surface coated with a material selected from the group consisting of ceramics and fluorinated resin.

3. The garbage disposer as claimed in claim 1, wherein said receptacle is a paper bag made of pulp compounded with synthetic resin.

4. The garbage disposer which comprises:

a container means having an opening defined therein and made of microwave shielding material;

a generally bag-like garbage receptacle having a receiving mouth defined therein and made of microwave permeable material, said garbage receptacle also having a multiple of perforations defined therein and being adapted to be removably accommodated within the container means with the mouth substantially aligned with the opening of the container means;

a microwave generating means for radiating microwaves into the container means to heat garbage contained in the garbage receptacle within the container means;

a drain passage means for draining a water component produced by the garbage as a result of microwave heating of garbage within the garbage receptacle, to an outside of the garbage disposer; and a bag retaining means cooperable with a peripheral lip region of the container means adjacent the opening thereof to retain a mouth-defining lip region of the bag adjacent the mouth thereof.

5. The garbage disposer as claimed in claim 4, wherein said container means has an inner surface coated with a material selected from the group consisting of ceramics and fluorinated resin.

6. The garbage disposer as claimed in claim 4, wherein said receptacle is a paper bag made of pulp compounded with synthetic resin.

7. The garbage disposer as claimed in claim 4, wherein said bag retaining means comprises a generally ring-shaped support member mounted on the peripheral lip region of the container means and having an inner diameter smaller than the inner diameter of the container means, and a generally ring-shaped retainer frame adapted to be removably seated on the support member in coaxial relationship therewith, said retainer frame when seated on the support member clamping the mouth-defining lip region of the bag in cooperation with the support member.

8. The garbage disposer as claimed in claim 7, further comprising a forced cooling means for forcibly cooling a vapor generated as a result of microwave heating of the garbage to cause it to condense into water droplets, said drain passage means including a drain passage, through which the water droplets are drained, and an exhaust passage means through which a gaseous medium used to cool the vapor is discharged, and a deodorizing means disposed on the exhaust passage for deodorizing the gaseous medium before the latter is discharged from the garbage disposer.

9. The garbage disposer as claimed in claim 7, further comprising an inner lid made of microwave permeable material adapted to selectively open and close an opening of the retainer frame.

10. The garbage disposer as claimed in claim 8, further comprising an inner lid made of microwave permeable material adapted to selectively open and close an opening of the retainer frame.

11. A garbage disposer which comprises:

a chamber-defining means made of microwave shielding material;

a container means disposed within the chamber-defining means and made of microwave permeable material;

a generally bag-like garbage receptacle having a receiving mouth defined therein and made of a material having both a microwave permeable property and a gas permeable property, said garbage receptacle being adapted to be removably accommodated within the container means with the mouth substantially aligned with the opening of the container means;

a microwave generating means for radiating microwaves into the container means to heat garbage contained in the garbage receptacle within the container means;

a forced air supply means for supplying a forced draft of air into a space defined between the chamber-defining means and the container means;

an exhaust port means through which the air supplied into the space is discharged to the outside of the garbage disposer; and a drain passage means for draining a water component produced by the garbage as a result of microwave heating of garbage within the receptacle, to an outside of the garbage disposer.

12. The garbage disposer as claimed in claim 11, wherein said container means has an inner surface coated with a material selected from the group consisting of ceramics and fluorinated resin.

13. The garbage disposer as claimed in claim 11, wherein said receptacle is a paper bag made of pulp compounded with synthetic resin.

14. The garbage disposer as claimed in claim 11, further comprising a forced cooling means for forcibly cooling a vapor generated as a result of microwave heating of the garbage to cause it to condense into water droplets, said drain passage means including a drain passage, through which the water droplets are drained, and an exhaust passage means through which a gaseous medium used to cool the vapor is discharged, and a deodorizing means disposed on the exhaust passage for deodorizing the gaseous medium before the latter is discharged from the garbage disposer.

15. A garbage disposer which comprises a container means having an opening defined therein and made of microwave shielding material;

a generally bag-like garbage receptacle having a receiving mouth defined therein and made of a material having both a microwave permeable property and a gas permeable property, said garbage receptacle being adapted to be removably accommodated within the container means with the mouth substantially aligned with the opening of the container means;

a microwave generating means for radiating microwaves into the container means to heat garbage contained in the garbage receptacle within the container means;

a heat recovering chamber disposed exteriorly of the container means;

an air supply means for supplying air into said heat recovering chamber;

a dishwasher disposed separate from the garbage disposer;

a supply piping for supplying the air, which has been heated within the heat recovering chamber, to the dishwasher; and a drain passage means for draining a water component produced by the garbage as a result of microwave heating of garbage within the receptacle, to an outside of the garbage disposer.

16. The garbage disposer as claimed in claim 15, wherein said container means has an inner surface coated with a material selected from the group consisting of ceramics and fluorinated resin.

17. The garbage disposer as claimed in claim 15, wherein said receptacle is a paper bag made of pulp compounded with synthetic resin.

18. A garbage disposer which comprises:

a container means having an opening defined therein and made of microwave shielding material;

a generally bag-like garbage receptacle having a receiving mouth defined therein and made of a material having both a microwave permeable property and a gas permeable property, said garbage receptacle being adapted to be removably accommodated within the container means with the mouth substantially aligned with the opening of the container means;

a microwave generating means for radiating microwaves into the container means to heat garbage contained in the garbage receptacle within the container means;

a heat recovering chamber disposed exteriorly of the container means;

a water supply means for supplying water into said heat recovering chamber;

a dishwasher disposed separate from the garbage disposer;

a supply piping for supplying the water, which has been heated within the heat recovering chamber, to the dishwasher; and a drain passage means for draining a water component produced by the garbage as a result of microwave heating of garbage within the receptacle, to an outside of the garbage disposer.

19. The garbage disposer as claimed in claim 18, wherein said container means has an inner surface coated with a material selected from the group consisting of ceramics and fluorinated resin.

20. The garbage disposer as claimed in claim 18, wherein said receptacle is a paper bag made of pulp compounded with synthetic resin.

21. A garbage disposer which comprises:

a container means having an opening defined therein and made of microwave shielding material;

a generally bag-like garbage receptacle having a receiving mouth defined therein and made of a material having both a microwave permeable property and a gas permeable property, said garbage receptacle being adapted to be removably accommodated within the container means with the mouth substantially aligned with the opening of the container means;

a microwave generating means for radiating microwaves into the container means to heat garbage contained in the garbage receptacle within the container means;

a drain passage means for draining a water component produced by the garbage as a result of microwave heating of garbage within the receptacle, to an outside of the garbage disposer; and a hot air supply means for supplying a forced draft of hot air into the container means to perform a drying process, at least a final stage of said drying process having a period during which the heating of the garbage is carried out solely by means of the hot air supply means.

22. The garbage disposer as claimed in claim 21, wherein said container means has an inner surface coated with a material selected from the group consisting of ceramics and fluorinated resin.

23. The garbage disposer as claimed in claim 21, wherein said receptacle is a paper bag made of pulp compounded with synthetic resin.

24. The garbage disposer as claimed in claim 21, wherein at least one of an electric power to be supplied to the heating means and an electric power to be supplied to the microwave generating means is varied during the microwave heating.

25. The garbage disposer as claimed in claim 21, wherein, when the water content of the garbage is higher than a predetermined value, the hot air supply means is utilized to heat the garbage within the garbage receptacle, but when the water content of the garbage decreases below the predetermined value, the microwave generating means is utilized to heat the garbage within the garbage receptacle.

26. The garbage disposer as claimed in claim 21, further comprising a deodorizing unit disposed on a passage extending between the container means and an exhaust port.

27. A garbage disposer which comprises:

a chamber-defining means made of microwave shielding material;

a container means made of microwave permeable material and having an opening defined therein, said container means being disposed within the chamber-defining means;

a generally bag-like garbage receptacle having a receiving mouth defined therein and made of a material having both a microwave permeable property and a gas permeable propertty, said garbage receptacle being adapted to be removably accommodated within the container means with the mouth substantially aligned with the opening of the container means;

a microwave generating means for radiating microwaves into the chamber-defining means to heat garbage contained in the garbage receptacle within the container means;

an air supply means for supplying air into the chamber-defining means;

a heating means for heating the air to be supplied into the chamber-defining means by the air supply means;

a drain passage means for draining both of a water component produced by the garbage as a result of microwave heating of garbage within the receptacle, and the air supplied into the container means, to an outside of the garbage disposer; and said container means having a plurality of perforations through which the air supplied into the chamber-defining means by the air supply means can flow upwardly from a bottom of the garbage receptacle.

28. The garbage disposer as claimed in claim 27, wherein said container means has an inner surface coated with a material selected from the group consisting of ceramics and fluorinated resin.

29. The garbage disposer as claimed in claim 27, wherein said receptacle is a paper bag made of pulp compounded with synthetic resin.

30. The garbage disposer as claimed in claim 27, wherein at least one of an electric power to be supplied to the heating means and an electric power to be supplied to the microwave generating means is varied during the microwave heating.

31. The garbage disposer as claimed in claim 27, wherein, when the water content of the garbage is higher than a predetermined value, the hot air supply means is utilized to heat the garbage within the garbage receptacle, but when the water content of the garbage decreases below the predetermined value, the microwave generating means is utilized to heat the garbage within the garbage receptacle.

32. The garbage disposer as claimed in claim 27, further comprising a deodorizing unit disposed on a passage extending between the container means and an exhaust port.

* * * * *